United States Patent [19]

Evans et al.

[11] 4,058,632

[45] Nov. 15, 1977

[54] LIGHT-WEIGHT, FLEXIBLE, EASY-OPEN, IMPERMEABLE PACKAGE SYSTEM

[75] Inventors: Albert E. J. Evans, Levedean; Peter G. Turner, Bordon, both of England

[73] Assignee: Koninklijke Emballage Industrie Van Leer B.V., Amstelveen, Netherlands

[21] Appl. No.: 731,164

[22] Filed: Oct. 12, 1976

Related U.S. Application Data

[63] Continuation of Ser. No. 533,423, Dec. 16, 1974, abandoned.

[51] Int. Cl.[2] ..... B65D 5/42

[52] U.S. Cl. ..... 426/126; 206/484; 229/3.5 MF; 229/48 R; 229/48 T; 426/87; 428/194; 428/457; 428/458

[58] Field of Search ..... 229/3.5 MF, 48 R, 48 SA, 229/48 T; 426/106, 113, 126, 410, 412, 415; 206/484; 428/194, 198, 200, 458, 457, 461

[56] References Cited

U.S. PATENT DOCUMENTS

| | | | |
|---|---|---|---|
| 1,398,840 | 11/1921 | Conley | 229/3.5 MF |
| 2,875,514 | 3/1959 | Doerr | 229/3.5 MF |
| 3,078,201 | 2/1963 | Christie | 426/126 |
| 3,204,760 | 9/1965 | Whiteford | 426/106 |
| 3,268,344 | 8/1966 | Kamm | 426/126 |
| 3,327,926 | 6/1967 | Kreamer | 229/3.5 MF |
| 3,391,024 | 7/1968 | Pierce | 29/195 E |
| 3,466,384 | 9/1969 | Martn | 229/3.5 MF |
| 3,578,239 | 5/1971 | Perlman | 229/48 T X |
| 3,625,712 | 12/1971 | Wilson | 426/412 |

*Primary Examiner*—Steven L. Weinstein
*Attorney, Agent, or Firm*—Lawrence Rosen; E. Janet Berry

[57] ABSTRACT

A light weight flexible easy open impermeable metal foil package including a peripheral thermoplastic seal an intermediate solder seal, and an inner thermoplastic seal.

2 Claims, 5 Drawing Figures

LIGHT-WEIGHT, FLEXIBLE, EASY-OPEN, IMPERMEABLE PACKAGE SYSTEM

CROSS-REFERENCE TO RELATED APPLICATIONS

The present application is a continuation of application Ser. No. 533,423, filed Dec. 16, 1974, now abandoned.

The present invention relates to a light-weight, flexible, easy-open, impermeable package system.

Existing flexible, easy open packs are commonly made of metal (often aluminium) foil laminated to a thermoplastic film which provides the ability to make easily heat sealed joints. Although a sufficiently low permeability for a large number of purposes can be obtained, nevertheless water vapour and other gases can permeate at a finite, albeit small, rate through the polymeric film exposed at the edges, and there is no indication of this having occurred.

Packages can be made completely impermeable by using welded or soldered joints, but these are in heavier materials which have no flexiblility (tin cans), and require special provisions for opening (e.g., aluminium tear-open end or use of special opening equipment) and a special preparation for the packing of certain goods.

For critical products even the small amounts of water or gas which can permeate into (or out of) existing flexible foil packs may be undesirable, and rigid welded containers may be uneconomical or impractical for certain applications.

Therefore it was aimed at providing an impermeable system retaining the advantage of light-weight, flexibility and ease of opening, providing some indications of its effectiveness, and suitable for radiation sterilization.

It was found now, that a package consisting of at least one single folded film of pore free metal or metal film laminate, optionally supported on one side on a suitable heat-resistant plastics film, the other side at least the edge area of which is coated with a solder and a further partial or complete coating of a heat-sealable thermoplastic material, and the edge area, sealed by means of the local application of heat and pressure, with the understanding that heating is stopped before exertion of pressure is stopped, to effect a metal seal or a metal seal and at least one plastic seal, meets said requirement. In addition to satisfying permeability requirements, it is possible under certain corrosive conditions, that joint integrity can only be maintained by isolating the metal joint from the package contents and/or the external environment while in addition it may be desirable to prevent contamination of the contents of the package by the components of the solder.

To meet these requirements the present invention preferably embodies a thermoplastic heat seal on one or both sides of the solder seal, i.e., complete peripheral joints are made in both materials.

Additionally, it may be desirable to include a desiccant and/or a gas or water sensitive indicator within the area bounded by the solder seal. Examples of desiccants are: calcium chloride, lithium chloride and silica gel.

The term "solder" includes tin-lead alloys but also embraces other metals and alloys which are heat fusible within the temperature limitations imposed by the other components of the package. The soldered joints may be obtained without the use of a flux.

Any thermoplastic heat sealable material can be used.

For ease of obtaining an adherent solder coating, copper foils are preferred but in principle other metal foils or metal foil laminates may be used provided the solder can be applied as an adherent film.

The published vapour permeability constants of polymers can be used to calculate the diffusion rates across polymer heat seals of known dimensions for defined conditions. The diffusion rate is directly proportional to the vapour pressure difference between inside and outside the seal, inversely proportional to the length of the diffusion path, i.e., the width of the seal, and directly proportional to the cross sectional area of the diffusion path, i.e., the thickness of the joint multiplied by the average perimeter of the joint. Thus, for a foil pack having a thermoplastic seal 3 mm wide, of total length 200 mm, and total thickness 0.05 mm, and for a gas or vapour having a vapour pressure difference across the seal of 50 mm of mercury, the diffusion rates into (or out of) the pack through the seal can be calculated. The published permeability data and the corresponding calculated diffusion rates into the pack described above are given in the following table.

TABLE 1

| Material | Gas | Quoted Permeability cc/cm²/sec/10 mm Hg | | Calculated Diffusion rate micro liters (at S.T.B.) per year | Calculated Diffusion rate micro grams per year |
|---|---|---|---|---|---|
| Low density | Water | 2100 | $\times 10^{-9}$ | 5500 | 4500 |
| polythene | $CO_2$ | 280 | | 740 | 1450 |
| 50 micron | Oxygen | 75 | | 200 | 280 |
| film | Nitrogen | 25 | | 66 | 83 |
| High density | Water | 300 | $\times 10^{-9}$ | 790 | 640 |
| POLYTHENE | $CO_2$ | 65 | | 170 | 340 |
| 50 micron | Oxygen | 15 | | 40 | 57 |
| film | Nitrogen | 5 | | 13 | 16 |
| POLY | Water | 800 | $\times 10^{-9}$ | 2100 | 1700 |
| PROPYLENE | $CO_2$ | 60 | | 160 | 310 |
| 50 micron | Oxygen | 20 | | 50 | 75 |
| film | Nitrogen | 4 | | 10 | 13 |
| SARAN | Water | 27 | $\times 10^{-9}$ | 70 | 57 |
| polyvinylidene | $CO_2$ | 0.6 | | 1.6 | 3.1 |
| chloride | Oxygen | 0.05 | | 0.1 | 0.2 |
| 50 micron film | Nitrogen | 0.01 | | 0.03 | 0.03 |
| POLY- | Water | 3200 | $\times 10^{-9}$ | 8400 | 6500 |
| VINYL CHLORIDE | $CO_2$ | 2 | | 5 | 10 |
| 50 micron | Oxygen | 2.4 | | 6 | 9 |
| film | Nitrogen | 0.8 | | 2 | 2.6 |

A more detailed understanding of the invention will be obtained from FIGS. 1, 2, 3, 4 and 5.

Figure 1:
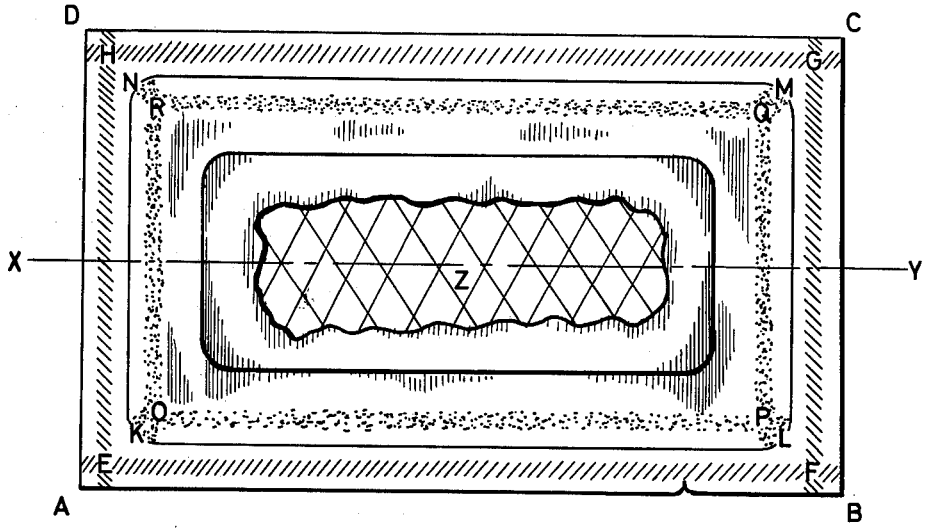
FIG. 1 is an upper view of the package, having a solder seal and a single inner thermoplastic seal.

In FIG. 1 A B C D is the outer edge of the package.

E F G H is the solder seal in the edge area.

Figure 4:
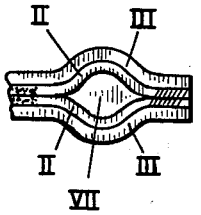
FIG. 4 is a possible embodiment of the seals.

K L M N is the boundary between solder in the edge area and the heat sealable plastics layer O P Q R, which can embody the feature depicted in FIG. 4.

Z is the space for the material to be packed.

Figure 2:
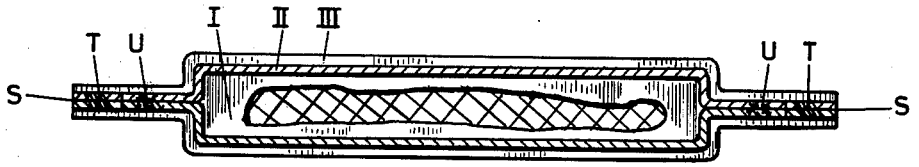
FIG. 2 is a cross view along the line X–Y.

In FIG. 2 S is the seal consisting of the edge area solder seal T and the plastics heat seal U.

I is the space for the material to be packed, II is the heat sealable plastics coating on the metal foil III.

Figure 3:
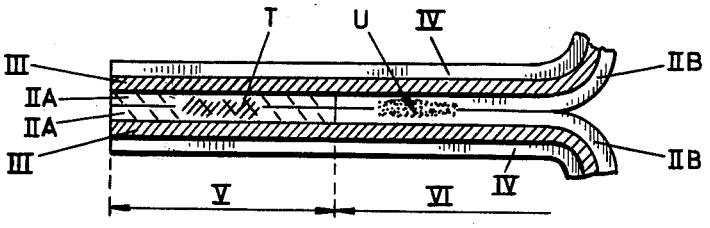
FIG. 3 is a detail of a part of the seals.

In FIG. 3 III is the metal foil,

IV is the optional supporting plastics film,

IIA is the solder coating,

IIB is the heat sealable thermoplastic coating,

T is the metal heat seal,

U is the plastics heat seal,

V is the solder coated area,

VI is the thermoplastic coated area.

In FIG. 4 III is the metal foil,

II is the heat sealable thermoplastic coating,

VII is the space for the desiccant.

Figure 5:
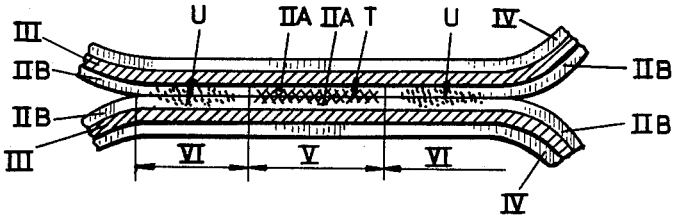
FIG. 5 is a preferred embodiment of the seals.

In FIG. 5 III is the metal foil,

IV is the optional supporting plastics film,

IIA is the solder coating (between the thermoplastic coating),

IIB is the heat sealable thermoplastic coating,

T is the metal heat seal

U are the plastics heat seals

V is the solder coated area

VI are the thermoplastic coated areas behind the unsealed outer edge area for easy peel-open of the package.

The following examples elucidate the invention and also provide comparisons of the performance of joints made by conventional methods. In all examples, unless specifically stated otherwise, the methods of making the seals and testing sachets were the same.

Seals were made using a conventional Sentinel 12—12 AS laboratory heat sealer using the impulse method of heating i.e., the surfaces to be joined are compressed between two narrow tapes of resistance wire, a preset heating voltage is applied across the ends of the heating bands for a preset time, and after a further preset time to allow the molten joint to solidify the clamping pressure released. The applied voltage and impulse time were adjusted to suit the different substrates and sealing coatings.

The effectiveness of joints was established primarily by a helium leak test using a Veeco MS9 mass spectrometer. For these tests, helium was blown into the sachets immediately before the final edge was sealed. The test was carried out in an evacuated chamber. It is capable of detecting leak rates as low as $0.15 \times 10^{-9}$ cc (at STP) per second. The test was repeated at least three times thereby subjecting the test sachet to three evacuation cycles, which in itself provided an additional severe test of the mechanical integrity and strength of the seals.

A zero leak rate (i.e., $<10^{-10}$ cc He/sec) in the helium leak test necessarily implies complete impermeability to water vapor. Nonetheless, sachets were also tested for water impermeability. A water indicator comprising a label with a dried-on 10 microlitre drop of 10 milli-molar cobaltous chloride, dehydrated to the blue state, was sealed into the sachet. (This quantity of cobaltous chloride requires approximately 10 micrograms of water to change from the anhydrous to the fully hydrated pink state). Sachets containing water indicator spots were exposed in air saturated with water vapour at 79° C, i.e., to a water vapor pressure of 340 mm of mercury. This test, in addition to confirming the impermeability of the joints, also shows the resistance to extreme storage conditions.

The suitability of the packs for irradation sterilization was tested by exposing sachets to a sufficient dose of gamma radiation to guarantee sterilization, namely exposure to 2.5 megarads. A radiation detection disc *) was included in the pack to indicate whether an adequate irradiation dose had reached the contents.

*) (Sessions Detex Radiation Indicator Labels)

EXAMPLE 1

Electroformed copper foil 33 microns thick, adhesively bonded to a supporting polyester film (ICI MELINEX) 25 microns thick, was electroplated with thin-lead solder (60% by weight tin, 40% by weight lead) to a thickness of 3 microns. A thin coating of non-corrosive activated resin flux (ALPHA 711-35 RELIAROS) was applied. Square sachets were first made from two 11 cm squares of this material by making heat seal joints 1 cm in from the four sides using the impulse sealer. The voltage was adjusted at 37.5 Volts, so as to produce a heat sealed joint in the tin-lead solder in 0.5 second. The square sachets were cut in half, to make two open sachets 5.5 × 11 cm. Water and radiation indicators were placed in the sachets, helium was blown in and the final side resealed. The sachets were tested as described, giving the results in Table 2.

EXAMPLE 2

The copper-polyester film described in Example 1 was coated with a vinyl heat sealable lacquer (SWALE FT 3244) in a pattern of rectangles corresponding to the areas within the soldered joints described in Example 1. The uncoated areas were electroplated with 60–40 tin-lead solder to a thickness of 14 microns. No flux coating was applied. Pairs of sachets were made from squares of this material as in Example 1, except that a second seal was made on each side inside the solder seal on the heat seal lacquer coated areas. Thus the final sachet had a complete double seal comprising an outer metallic seal (solder) and an inner plastic seal (heat seal lacquer). These sachets were filled and tested as described. The results are given in Table 2. The Voltage value used at the sealing was 37.5 Volts (Metal and Polymer).

EXAMPLE 3

The system described in Example 2 was repeated using an 8 microns layer of tin-lead solder and an additional coating of heat seal lacquer around the periphery of the 11 cm squares. Sachets, 11 cm square, were made with a solder joint about 1 cm in from the edge, a heat seal lacquer joint within the solder joint, and a third outer seal in the heat seal lacquer on the outer edge of the sachet. The metal seal was thus protected from both the inside and outside environment. Indicators and helium gas were sealed into the pack for testing.

In the sealing step the voltage was adjusted at 37.5 Volts Metal, 37.5 V inner and 30 V outer lacquer.

EXAMPLE 4

The same copper-polyester substrate was electroplated with 8 microns of pure tin and given a light application of flux solution as in Example 1. Sachets, 5.5 × 11 cm, were made as described in Example 1 and tested and gave the results in Table 2.

In the sealing step the Voltage was adjusted at 45 Volts.

EXAMPLE 5

Copper-polyester laminate, as used in the previous examples, was electroplated with 13 microns of indium. A thin coating of flux (as in Example 1) was applied. Sachets were made, using a lower heating voltage, as described in Example 1. The results of the tests are given in Table 2. In the sealing step the Voltage was adjusted at 32.5 V.

EXAMPLE 6

The same copper-polyester laminate was "tinned," using a soldering iron on the copper surface where joints were to be made, with indium-tin eutectic alloy. A thin coating of flux (as in Example 1) was applied to the indium-tin surface, and sachets made as described in Example 1 by making heat sealed joints in the indium-tin coating. These sachets were tested in the same way as the previous examples.

In the sealing step the Voltage was adjusted at 25 V.

EXAMPLE 7

Aluminum foil 25 microns thick, adhesively bonded to polyester film (ICI MELIMEX) 50 microns thick, was electroplated with 12 microns of tin-lead solder after first pretreating the aluminium surface. The pretreatment comprised a zincate dip treatment *) followed by a thin copper electroplating treatment. Sachets were made with heat sealed joints in the solder in the same way as described in Example 1. These sachets were tested and gave the results indicated in Table 2.

*) (Cannings Bondal Process)

In the sealing step the Voltage was adjusted at 37.5 V.

EXAMPLE 8

Steel foil, in fact tinplate rolled to a thickness of 25 microns, as cleaned and electroplated with 12 microns of 60% by weight tin, 40% by weight lead solder. Sachets were made as in Example 1 with and without a thin coating of flux (as in Example 1) preapplied to the solder coating. Tests on these sachets gave the results shown in Table 2.

In the sealing step the Voltage was adjusted at 50 V.

EXAMPLE 9

The principle of including a desiccant or indicator between sealed joints of a sachet was demonstrated by this example. A strip of filter paper, approximately 1 × 6 cm, was saturated with a concentrated solution of cobaltous chloride which was then dried and desiccated to the anhydrous blue state. This strip provided both the ability to absorb water and, on turning pink, an indication of water having been absorbed and a resultant rise in relative humidity inside the pack. The absence of a colour change indicates that the relative humidity has been maintained below that of the equilibrium water vapor pressure of the hydrated (pink) state of cobaltous chloride.

Two sets of 11 cm square sachets were made from the copper-polyester laminate. The inner area was coated with vinyl heat seal lacquer (SWALE FT 3244) and the outer edges electroplated with 12 microns of tin-lead solder. In one set a desiccant strip was attached along one edge on the lacquer. Solder heat seals were made on the four sides, with helium gas and water indicator and irradiation indicator being placed in the pack before sealing the fourth side. Heat seals were then made in the lacquer coated areas either side of the desiccant strip and in the same positions on the sachets without the desiccant strip. The total impermeability of the pack was established by a helium leak test under vacuum (see Table 2). The effectiveness of the desiccant in preventing (or strictly delaying) permeation of water vapor into the pack was tested by cutting off the totally impermeable metal seal on the side with the strip, and on the corresponding sides of the sachets made without the desiccant strip, and exposing the sachets to water vapor in the same test as was used for the other examples. The result of the test are given in Table 2.

In the sealing step the voltage was adjusted at 37.5 V.

EXAMPLE 10

This example provides a comparison of the performance to be expected from conventional heat sealed flexible sachets. The material used was a commercial foil made for heat sealed packs. It comprised an aluminium foil 25 microns thick, i.e., thick enough to be free from pores, coated with a vinyl heat seal lacquer. Sachets were made from this material with heat sealed joints in the lacquer on the four sides, as described for the metal joints in Example 1, but using an appropriately lower heating voltage for the heat seals. A water indicator and helium gas were sealed into the pack for testing. The results of tests are shown in Table 2.

In the sealing step the voltage was adjusted at 30 V.

EXAMPLE 11

This example provides an accelerated comparison of the permeability performance of heat sealed joints in polymers.

Sachets were made using the same 33 micron copper, 25 micron polyester as used in the earlier examples by heat sealing a film of Surlyn A (Du Pont ionomer resin) 300 microns thick between the copper surfaces using the same processes as previously described. In the sealing step the voltage was adjusted at 37.5 V. The thickness of the material allowed the dimensions of the resultant seals to be measured, from which a theoretical estimate of the diffusion rate into or out of the pack could be calculated, as follows:

| | | |
|---|---|---|
| Quoted helium permeability of Surlyn A film | | 786 cc/645 $cm^2$ (100 sq in)/24 hrs/25.4 microns (0.001 in)/atmosphere |
| Area of diffusion path | = | thickness of sealed joint multiplied by overall length of seal |
| | = | 280 microns × 264 mm |
| Length of diffusion path | = | Width of resultant seal |
| | = | 7.5 mm |
| Pressure of helium | = | not known, but estimated at about ½ atmosphere |
| Calculated helium diffusion rate of sachet | = | $18 \times 10^{-9}$ cc He/sec. |

A similar calculation for the water diffusion rate at the water vapor pressure of the test at 79° C gave a value of 6 micrograms per 24 hours. (Based on quoted water vapor permeability at 30 ° C).

Helium leak tests and water vapor exposure tests were carried out as for the previous examples, and the results are given in Table 2.

TABLE 2

Results of Tests carried out on Examples.

| Example No. | Helium diffusion* rate cc/sec. | Water diffusion** Indicator changed | Helium diff. after water-test | Radiation*** Sterilisation | Helium diffusion rate after Radiation sterilisation |
|---|---|---|---|---|---|
| 1 | zero | nil for 28 days | zero | positive | zero |
| 2 | " | " | " | " | " |
| 3 | " | " | " | " | " |
| 4 | " | " | " | " | " |
| 5 | " | " | " | " | " |
| 6 | " | " | " | " | " |
| 7 | " | " | " | " | " |
| 8 (fluxed and non-fluxed) | " | " | " | " | " |
| 9 (without desiccant) | " | Some permeation after 20 days (metal point removed from one side) | Not measured | " | Not measured |
| (with desiccant) | " | Nil (metal point removed from one side) | " | " | " |
| 10 | 300–1500 × $10^{-9}$ (4 samples) | yes, after 8 days | " | " | " |
| 11 | 19 – 28 × $10^{-9}$ (4 samples) (Calculated- 18 × $10^{-9}$ from the data in example 11) | yes, after 8 days | " | " | " |

*zero indicates less than detectable minimum of 0.15 × $10^{-9}$ cc/sec.
**Nil = cobaltous chloride spot remained blue; yes = blue colour of spot lost.
***Positive = yellow indicator disc turned red.

EXAMPLES - SUMMARY

| Example No. | Substrate metal | Solder type | Application of solder | Plastics seal | Remarks |
|---|---|---|---|---|---|
| 1 | copper, 33/μ | tin-lead, 3/μ | electroplating | none | |
| 2 | copper, 33/μ | tin-lead, 14/μ | electroplating | one | |
| 3 | copper, 33/μ | tin-lead, 8/μ | electroplating | two | |
| 4 | copper, 33/μ | tin, 8/μ | electroplating | none | |
| 5 | copper, 33/μ | indium, 13/μ | electroplating | none | |
| 6 | copper, 33/μ | indium-tin | tinning (melting-on) | none | |
| 7 | aluminum 25/μ | tin-lead, 12/μ | electroplating | none | all with copper treatment |
| 8 | steel foil, 25/μ | tin-lead 12/μ | electroplating | none | |
| 9 | copper 33/μ | tin-lead 12/μ | electroplating | two | with desiccant |
| 10 | aluminum 25/μ | none | — | one | vinyl lacquer |
| 11 | copper, 33/μ | none | — | one | Surlyn A |

EXAMPLE 12

An electro-formed copper foil 33 microns thick, adhesively bonded to a supporting polyester film (ICI MELINEX) 25 microns thick, was electroplated with tin lead solder (60% by weight tin, 40% by weight lead) to a thickness of 12.5 microns. Prepared strips of material, solder faces in contact, were then subjected to bar sealing cycles. In some cases a flux was introduced at the solder-solder interface while in others the surfaces were as prepared. Sealing bar temperatures were varied from below the melting point of the solder (up to 232° C) up to a temperature whereby degradation of the backing polymer film occurred, clamping pressures were varied within the capacity of the machine (5 to 80 psi line pressure) and time was varied from 1 to 30 seconds.

Melting of the solder occurred at temperatures from 190° to 232° C, said temperature was maintained for 30 seconds. Assessment of joint effectiveness was made by hand peel and visual observation. No measurable peel strength was apparent for samples not exhibiting melting, all of those where melting was apparent (including those using flux) exhibited variable peel characteristics while inspection of the joint area confirmed the intermittent nature the joint formed. Comparison with samples produced as described in example 2 but with the exclusion of the heat sealable lacquer (SWALE FT 3244) showed the totally different character of the two joints. Impulse sealed joint had relatively uniform peel characteristics and obvious joint continuity; bar sealed joints all exhibited discontinuity. It can therefore be concluded that a true metallurgical joint is not formed by bar sealing and therefore an impermeable package cannot be achieved in times up to 30 seconds by the use of a bar sealing technique.

We claim:

1. A light-weight, flexible, easy-open, impermeable package containing water or air sensitive materials, said package being produced from a porefree metal foil sheet, said sheet having a heat resistant package-supporting plastic film on the outer surface thereof; said sheet being folded upon itself along a median line with the heat resistant film located exteriorly to provide top and bottom wall portions; relatively narrow and continuous peripheral opposed bands of solder on the inner surface of each of said top and bottom wall portions, said opposed bands being located in overlying mating relationship and being spaced inwardly from the peripheral edges of said top and bottom wall portions; thermoplastic film coatings on said facing top and bottom wall portions in a pattern of two concentric rectangles on each of said facing top and bottom wall portions corresponding to areas interiorly and exteriorly of said peripheral bands of solder; said two concentric rectangles on each of said portions being in overlying mating relationship; said opposed bands of solder being sealed to each other providing a complete metal seal through the top and bottom foil sheets; and said thermoplatstic coatings being sealed to each other providing a thermoplastic peripheral seal through said top and bottom wall portions on each side of said solder bands seal providing an interior open area between said top and bottom wall portions for the reception of the material being packaged, said interior open area being surrounded by a plurality of concentric hermetic seals including a peripheral thermoplastic seal, an intermediate solder seal, and an inner thermoplastic seal.

2. A light-weight, flexible, easy-open, impermeable package containing water or air sensitive materials, said package being produced from a pair of identical metal foil sheets constituting top and bottom wall portions, each of said wall portions having a heat resistant package-supporting plastic film on the outer surface thereof; relatively narrow and continuous peripheral opposed bands of solder on the inner surface of each of said top and bottom wall portions, said opposed bands being located in overlying mating relationship and being spaced inwardly from the peripheral edges of said top and bottom wall portions; thermoplastic film coatings on said facing top and bottom wall portions in a pattern of two concentric rectangles on each of said facing top and bottom wall portions corresponding to areas interiorly and exteriorly of said peripheral bands of solder; said two concentric rectangles on each of said portions being in overlying mating relationship; said opposed bands of solder being sealed to each other providing complete metal seal through the top and bottom foil sheets; and said thermoplastic coatings being sealed to each other providing a thermoplastic seal through said top and bottom wall portions on each side of said solder bands seal providing an interior open area between said top and bottom wall portions for the reception of the material being packaged, said interior open area being surrounded by a plurality of concentric seals including a peripheral thermoplastic seal, an intermediate solder seal, and an inner thermoplastic seal.

* * * * *